United States Patent [19]

Sullivan

[11] Patent Number: 4,625,882

[45] Date of Patent: Dec. 2, 1986

[54] TOY-LIKE CEREAL SERVING APPARATUS

[76] Inventor: Mark Sullivan, Box 182A, Rte. 1, East New Market, Md. 21631

[21] Appl. No.: 691,559

[22] Filed: Jan. 15, 1985

[51] Int. Cl.[4] ..... A47G 19/02; A47G 19/06

[52] U.S. Cl. ..... 220/23.83; D7/5; D7/27; 206/457; 220/20; 229/8

[58] Field of Search ..... 220/20, 22, 23.83, 23.86; D7/5, 27, 38; 229/1.5 C, 8; 206/457

[56] References Cited

U.S. PATENT DOCUMENTS

| | | | |
|---|---|---|---|
| D. 11,568 | 1/1880 | Koones | D7/5 |
| D. 102,457 | 12/1936 | Spence | D7/5 |
| D. 113,712 | 3/1939 | Moebus | D7/27 |
| D. 164,077 | 7/1951 | Wendell | D7/5 |
| D. 176,167 | 7/1955 | Hubbard | D7/5 |
| 700,653 | 5/1902 | Jobson | 229/1.5 C |
| 898,142 | 9/1908 | Schickerling | 220/23.86 |
| 2,789,749 | 4/1957 | Pearce | 229/8 |
| 3,381,876 | 5/1968 | Biggins | 229/1.5 C |
| 4,069,940 | 1/1978 | Naimoli | 220/20 |

FOREIGN PATENT DOCUMENTS

| | | | |
|---|---|---|---|
| 1211926 | 3/1960 | France | 229/1.5 C |

*Primary Examiner*—George E. Lowrance

*Attorney, Agent, or Firm*—Birch, Stewart, Kolasch & Birch

[57] ABSTRACT

A toy-like cereal serving apparatus integrates a bowl, milk container and serving spoon into a common theme. The theme is that of a sailing-ship. The bowl is boat-shaped; the milk container is pivotally supported on top of the ship's mast; and the serving spoon is stored on the boat-shaped bowl in the position of the rudder.

1 Claim, 2 Drawing Figures

TOY-LIKE CEREAL SERVING APPARATUS

BACKGROUND OF INVENTION

The present invention relates to a food serving bowl or the like. More particularly, the present invention relates to apparatus for serving dry breakfast cereal in a creative and efficient manner.

Conventional apparatus for serving dry cereal is made up of standard but separate household utensils including a bowl in which the cereal is served, a pitcher for milk or cream, a sugar bowl, if needed, and a spoon. As is well known, dry breakfast cereal is a very popular food for small children because it appeals to their tastes and has an adequate nutritional value.

However, quite often, as with any other task involving small children it is difficult to capture or keep their attention long enough to either begin or complete the task at hand. The serving and consumption of cereal is no exception to this general rule.

Accordingly, a need in the art exists for a toy-like cereal serving apparatus which will capture and keep the attention of small children to entice them to begin eating and complete the consumption of servings of cereal.

Another problem that every parent has most probably encountered in serving dry cereal to their children is the timing in connection with adding of milk to the dry cereal. In the standard morning scenario, one tells his child that breakfast is served; the child responds, "I will be right there Dad;" "Dad" pours the milk from a pitcher into the bowl; ten minutes later the child has still not come to the breakfast table; the child finally comes, tastes the cereal, and says, "Dad, this is too soggy. I can't eat this!"

An alternative approach is to let the child pour the milk into the bowl. However, this normally results in a total disaster, the full contents of the pitcher being spilled.

SUMMARY OF THE INVENTION

Accordingly, it is a primary object of the present invention to provide a cereal serving apparatus which captures the attention of small children and provides a satisfactory means of adding measured quantities of milk into the cereal at an appropriate time.

It is another object of the present invention to provide an apparatus for serving cereal in the form of a kit including a bowl, milk container and spoon integrated into a structure with a common toy-like theme.

The objects of the present invention are fulfilled by providing apparatus for serving food comprising:

a bowl for containing a serving of said food;

a container for dispensing additional ingredients into said bowl compatible with said serving of food; and support means for pivotally supporting said container above said bowl, said support means providing the container with a storage position in which said additional ingredients are stored above said bowl and a dispensing position in which said ingredients are poured into said bowl, said container being pivotable between said storage and dispensing positions.

The bowl and container are integrated into a common toy-like theme. The bowl is boat-shaped to resemble a sailing ship and the container resembles a crow's-nest on top of the ships' mast. A spoon may be mounted on the boat-shaped bowl in such a manner as to depict the rudder of a boat. Accordingly, the overall toy-like appearance of the cereal serving apparatus captivates the attention of small children.

In addition the milk container on top of the ship's mast has a volume with a predetermined ratio to the bowl volume, so that measured quantities of milk may be added to the dry cereal (just prior to consumption) in the bowl by the small child without the parents' close supervision. Therefore, the cereal will not become soggy and will be mixed with consistent quantities of milk compatible with good taste.

BRIEF DESCRIPTION OF THE DRAWINGS

The objects of the present invention and the attendant advantages therof will become more readily apparent by reference to the following drawings wherein like reference numerals refer to like parts.

DETAILED DESCRIPTION OF PREFERRED EMBODIMENTS

Figure 1:
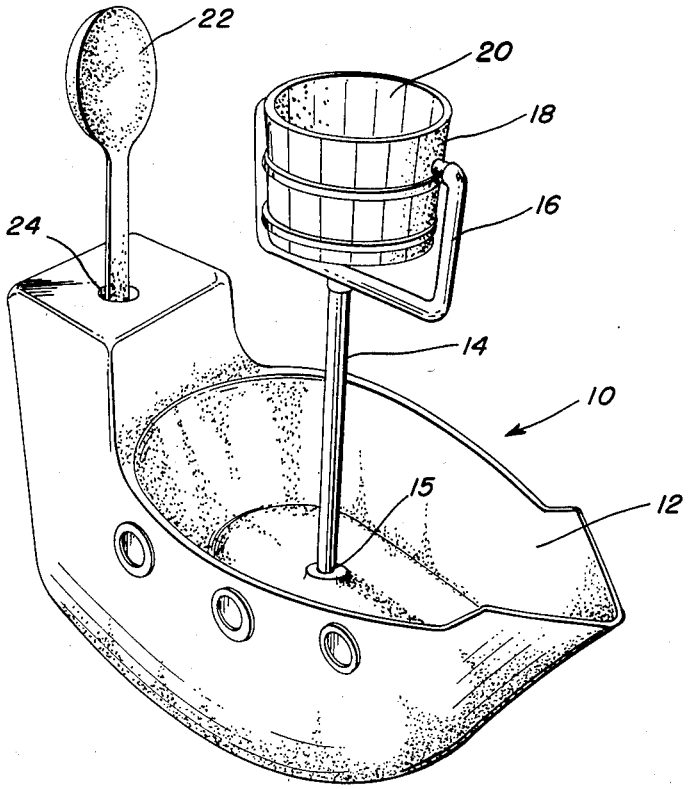
FIG. 1 is a perspective view of a first embodiment of a cereal serving apparatus according to the present invention.

Referring to FIG. 1, there is illustrated a boat-shaped cereal bowl 10 having a serving reservoir 12 for containing dry cereal or the like. Extending from a socket 15 in the bottom thereof is a rod 14 resembling the mast of a ship. On the top end of rod 14 is a U-shaped bracket 16 (see also FIG. 2) for pivotally supporting at points 18 a container 20 for milk or the like. The volume of container 20 is chosen in relation to the volume of a cereal serving in reservoir 20, so that container 20 holds a quantity of milk compatible with a desired blend of dry cereal to be mixed therewith in bowl reservoir 12.

Container 20 is normally in the position shown with the opening thereof facing upwardly for receiving and storing milk therein poured from a pitcher or milk carton. However, just prior to serving of the cereal, container 20 is tipped about pivot points 18 to a dispensing position to pour milk into the cereal bowl 10.

Rod 14 may be removably disposed in socket 15 for cleaning purposes. The entire structure is preferably a high temperature resistant plastic, which may be washed in a conventional diswasher without damage.

Bowl 10 may also include a socket 24 for removably supporting a serving spoon 22. The serving spoon is so positioned that it resembles the rudder of the associated sailing ship.

The toy-like appearance of this apparatus increases the chances of captivating the child's attention to facilitate the complete consumption of a cereal serving, and perhaps a second serving due to a desire to tip a second quantity of milk into the bowl. Furthermore, the milk is only added just prior to the time of consumption and in controlled quantities consistent with good taste.

Figure 2:
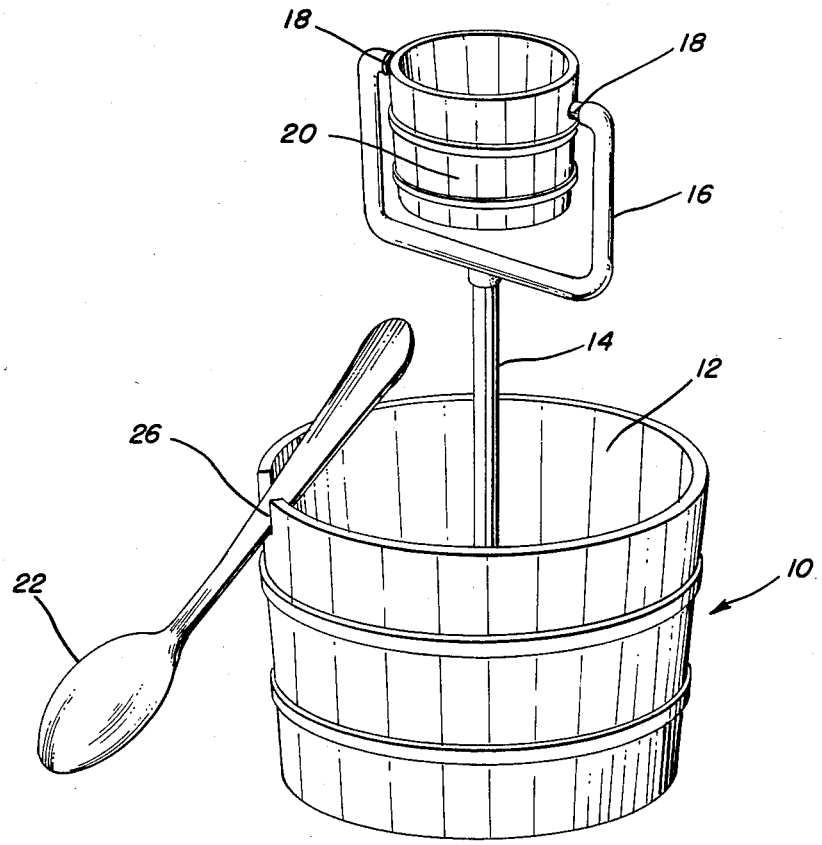
FIG. 2 is a perspective view of a second embodiment of a cereal serving apparatus according to the present invention.

In the embodiment of FIG. 2, the bowl 10 is more tub-shaped than boat-shaped but the overall theme is still that of a sailing ship. In addition the serving spoon 22 is supported in a slot 26 to more closely resemble a ship's rudder.

In operation, a serving of dry cereal is added to bowl 10. Milk is then added to container 20. These preliminary serving steps are preferably performed by a parent or adult before the child is called to the table. The child may then have the satisfaction of tipping container 20 to add his or her own serving of milk to the dry cereal. The associated serving spoon 22 may then be removed from the holder to consume the serving of cereal.

The apparatus described hereinbefore may be modified as would occur to one or ordinary skill in the art without departing from the spirit and scope of the present invention.

What is claimed is:

1. A toy-like apparatus for serving food comprising:

(a) a boat-shaped bowl resembling the shape of the hull of a sailing ship for containing said food;

(b) a support resembling a mast of the sailing ship extending upwardly from the bowl;

(c) a container for ingredients to be added to the food in the container pivotally mounted on the top of said support, said container resembling a crow's nest of the sailing ship; and (d) a spoon removably mounted on a tail end of said bowl in such a position that it resembles the rudder of the sailing ship.

* * * * *